US009010711B2

(12) United States Patent
Pleiman et al.

(10) Patent No.: US 9,010,711 B2
(45) Date of Patent: Apr. 21, 2015

(54) HEIGHT ADJUSTMENT MECHANISM FOR JUVENILE PRODUCT

(75) Inventors: Brian R. Pleiman, Troy, OH (US); Andrew R. Davis, Huber Heights, OH (US); David R. Sander, Liberty Township, OH (US)

(73) Assignee: Evenflo Company, Inc., Miamisburg, OH (US)

( * ) Notice: Subject to any disclaimer, the term of this patent is extended or adjusted under 35 U.S.C. 154(b) by 0 days.

(21) Appl. No.: 13/475,282

(22) Filed: May 18, 2012

(65) Prior Publication Data

US 2013/0306826 A1 Nov. 21, 2013

(51) Int. Cl.

| | |
|---|---|
| ***F16M 13/00*** | (2006.01) |
| ***A47B 81/00*** | (2006.01) |
| ***A47D 13/10*** | (2006.01) |

(52) U.S. Cl.

CPC ..... *A47B 81/00* (2013.01); *A47D 13/107* (2013.01)

(58) Field of Classification Search

USPC ..... 248/423, 125.3, 407; 472/103, 135, 472/118, 105; 297/274, 344; 482/69, 77

See application file for complete search history.

(56) References Cited

U.S. PATENT DOCUMENTS

| | | | | | |
|---|---|---|---|---|---|
| 1,326,363 | A | * | 12/1919 | Michelin | 248/407 |
| 1,855,245 | A | * | 4/1932 | Kuenzel | 248/423 |
| 4,964,606 | A | * | 10/1990 | Beam et al. | 248/333 |
| 5,690,383 | A | * | 11/1997 | Meeker | 297/274 |
| 5,700,201 | A | * | 12/1997 | Bellows et al. | 472/103 |
| 6,209,840 | B1 | * | 4/2001 | Chen | 248/407 |
| 6,932,709 | B1 | | 8/2005 | Gubitosi et al. | |
| 7,296,855 | B1 | * | 11/2007 | Link et al. | 297/353 |
| 7,438,644 | B2 | | 10/2008 | Gubitosi et al. | |
| 7,614,979 | B2 | | 11/2009 | Thomson et al. | |
| 7,727,076 | B2 | | 6/2010 | Bapst et al. | |

* cited by examiner

*Primary Examiner* — Bradley Duckworth
(74) *Attorney, Agent, or Firm* — Baker & Hostetler LLP

(57) ABSTRACT

A juvenile product height adjustment mechanism which allows for easy, secure adjustment by a caregiver is comprised of a rotatable knob received within a sliding channel and rotatably but securely attached to a slider.

13 Claims, 4 Drawing Sheets

HEIGHT ADJUSTMENT MECHANISM FOR JUVENILE PRODUCT

BACKGROUND OF THE INVENTION

1. Field of the Invention

The present invention relates generally to juvenile products, such as multiple infant activity centers for use by children and their caregivers, and more particularly to height adjustment mechanisms for use in connection with such products.

2. Description of the Related Art

Juvenile products are widely used by caregivers. Many of those products, such as multiple infant activity centers, have seating portions for a child, or other aspects, that occasionally need adjustment to accommodate children of different sizes. It is generally desired that such adjustment quick and easy for the caregiver, but result in a secure adjustment.

While various devices have been used in the past to accomplish such adjustment, most of those prior art devices have been lacking in ease of adjustments, security, or both.

In sum, the prior art devices do not provide the important advantages of allowing easy adjustment of the juvenile products, such as seat position in multiple infant activity centers.

SUMMARY OF THE INVENTION

It is an aspect of the present invention to provide a height adjustment mechanism for a juvenile product that is easy for use by a caregiver and that provides a secure adjustment. Preferably, the height adjustment mechanism of the present invention allows for at least two separate adjustment heights and is designed in a manner that it may be assembled easily and quickly by a consumer.

More specifically, the height adjustment mechanism of the present invention preferably consists of a rotatable knob that fits in a channel on the juvenile product being adjusted. The knob preferably includes a handle on a top portion thereof to allow a user to rotate the knob between an adjustment position and a fixed position. Preferably, the knob also includes a shank having a rectangular, narrow cross section at its middle portion and includes a securing end-cap at its end.

Also in a preferred embodiment, the height adjustment mechanism of the present invention preferably includes a channel shaped to receive the rotatable knob slidingly therethrough and which preferably includes at least 2 adjustment lobes for receiving the head of the rotatable knob. The knob preferably includes a transverse handle shaped for easy manipulation by a caregiver.

Preferably, in operation, the height adjustment mechanism of the present invention is operated by the caregiver rotating the adjustable knob so that the handle is parallel to the direction of travel of the adjustment slider thus allowing the rectangular shank of the rotatable knob to slide within the channel Then when the desired adjustment position is reached, i.e. the desired lobe of the channel, the caregiver rotates the handle to a position transverse to the channel, thereby securely locking the slider, and anything attached thereto, securely in place.

These and other aspects and objects, along with advantages and features of the invention disclosed herein, will be made more apparent from the description, drawings, and claims that follow.

BRIEF DESCRIPTION OF THE DRAWINGS

The foregoing and other aspects, objects, features, and advantages of the present invention, as well as the invention itself; will be more fully understood from the following description of preferred embodiments, when read together with the accompanying drawings, in which.

DETAILED DESCRIPTION

Figure 1:
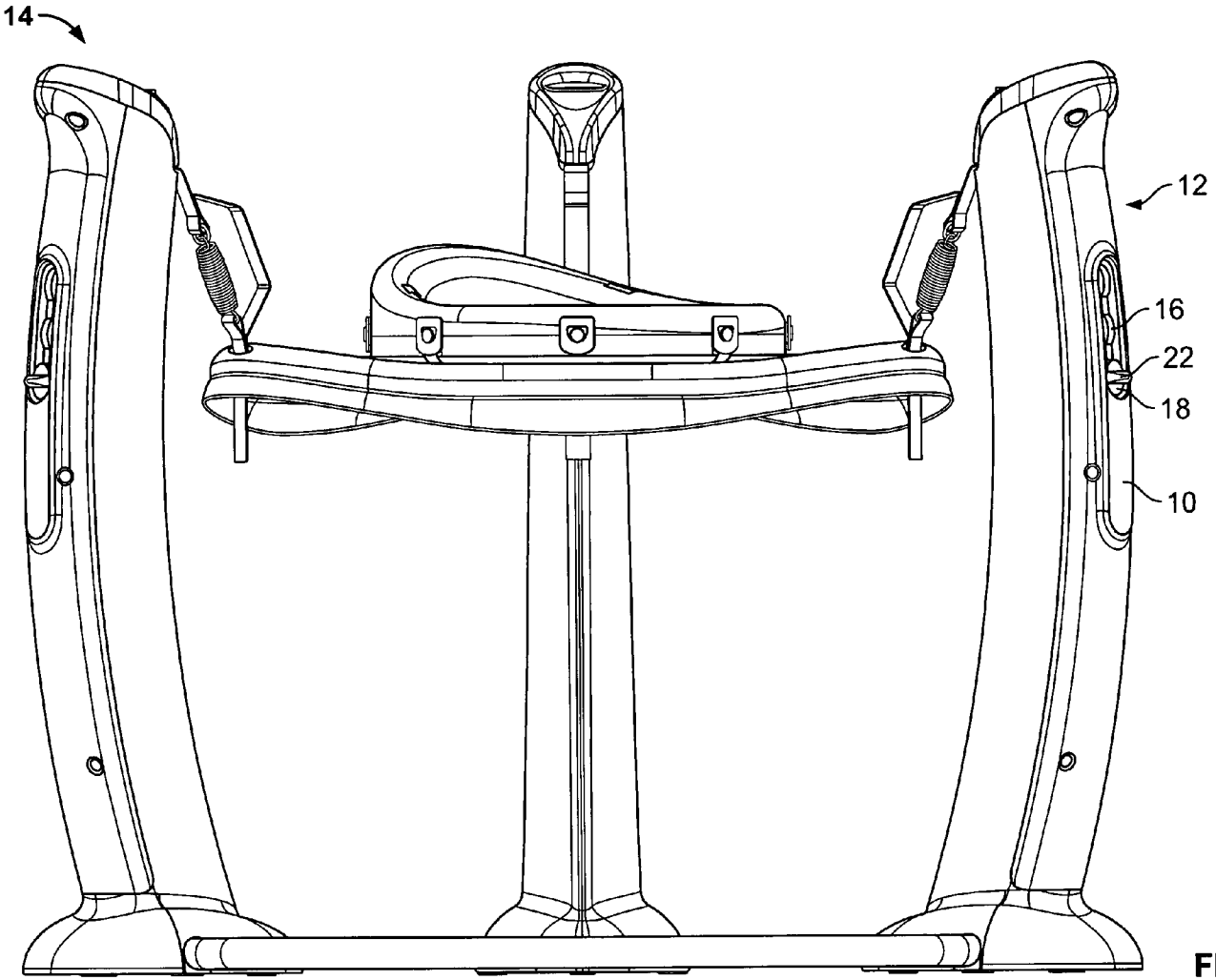
FIG. 1 is a perspective view of a multiple infant activity center utilizing a height adjustment mechanism in accordance with the present invention.
Figure 2:
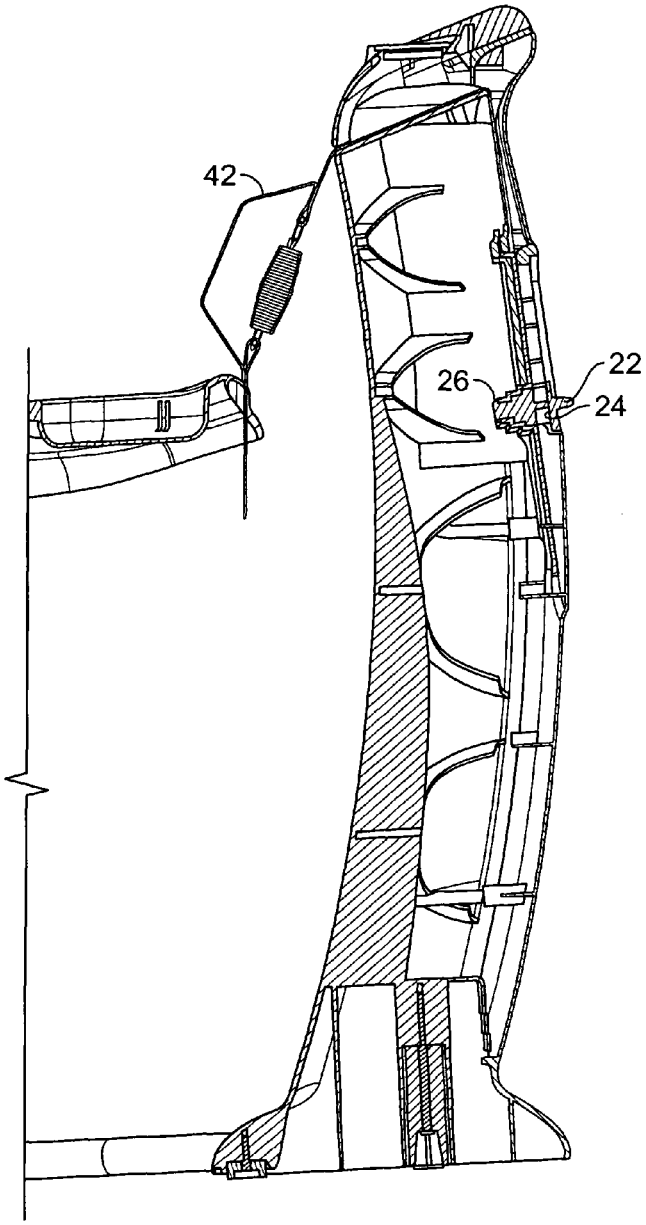
FIG. 2 is a cutaway side elevation view of the height adjustment mechanism of FIG. 1.
Figure 3:
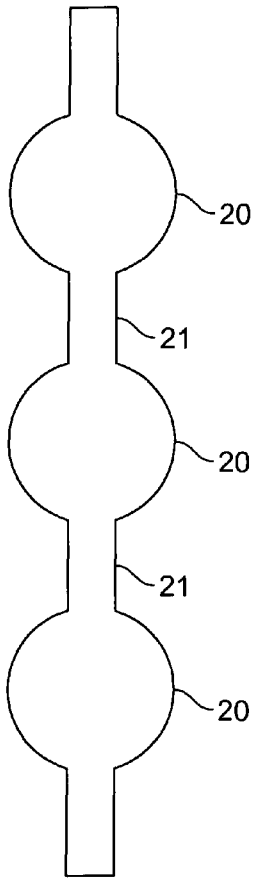
FIG. 3 is a schematic view of an adjustment channel for use in connection with the height adjustment mechanism of FIG. 1.

Referring to FIG. 1, an embodiment of a height adjustment mechanism in accordance with the present invention preferably consists of a height adjustment cover plate 10 incorporated into a portion of a juvenile product, such as a tower 12 on a multiple infant activity center 14. The plate 10 preferably includes a channel 16 shaped to receive a rotatable knob 18 slidingly therethrough and which preferably includes at least 2 adjustment lobes 20 that are attached by narrow channels 21. The knob 18 preferably includes a transverse handle 22 shaped for easy manipulation by a caregiver.

Figure 4:
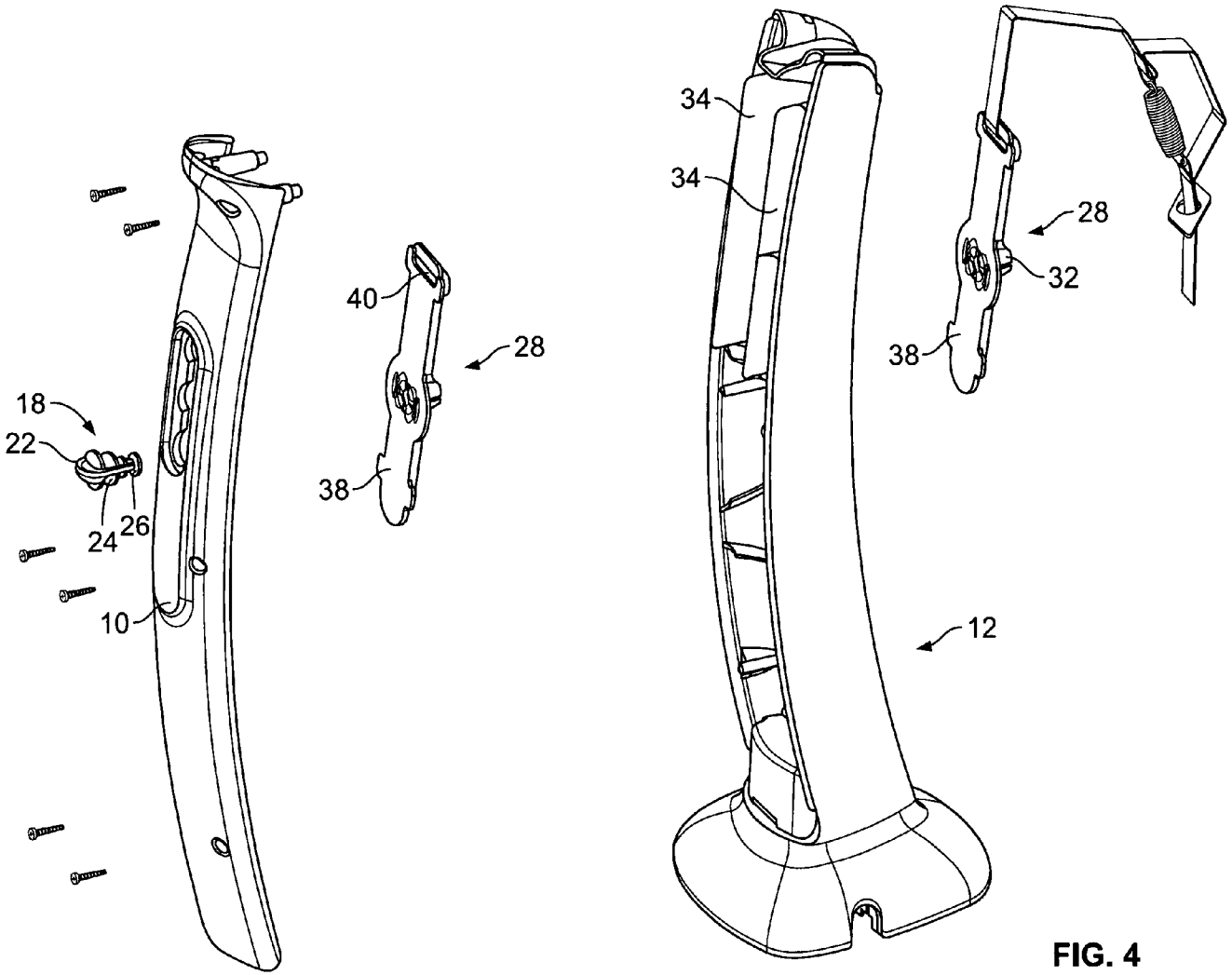
FIG. 4 is an exploded perspective view of the height adjustment mechanism of FIG. 1.
Figure 5C:
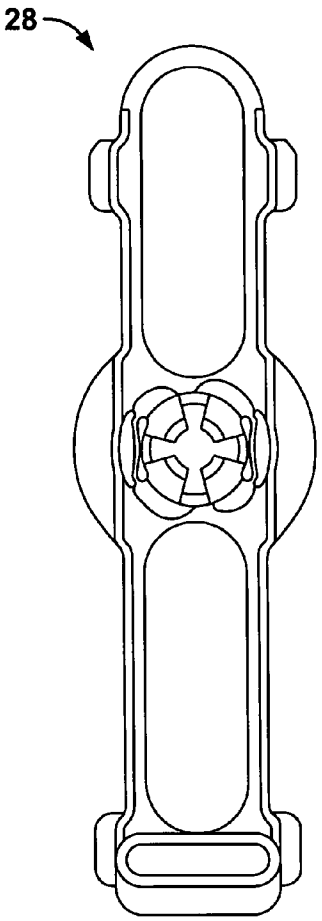
FIGS. 5A, 5B, and 5C, are top plan, side elevation, and bottom plan views of an adjustment slider for use in connection with the height adjustment mechanism of FIG. 1.
Figure 5B:
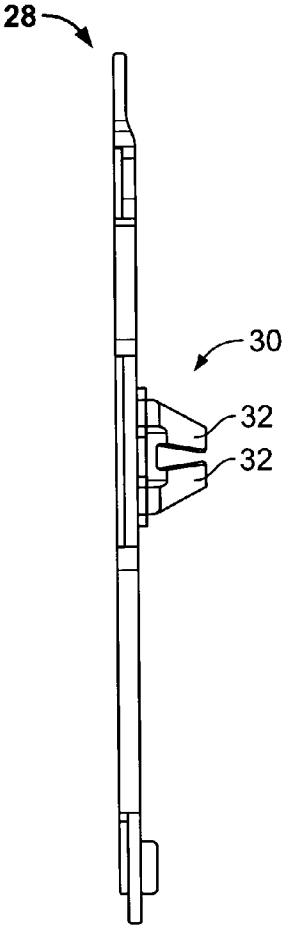
Figure 5A:
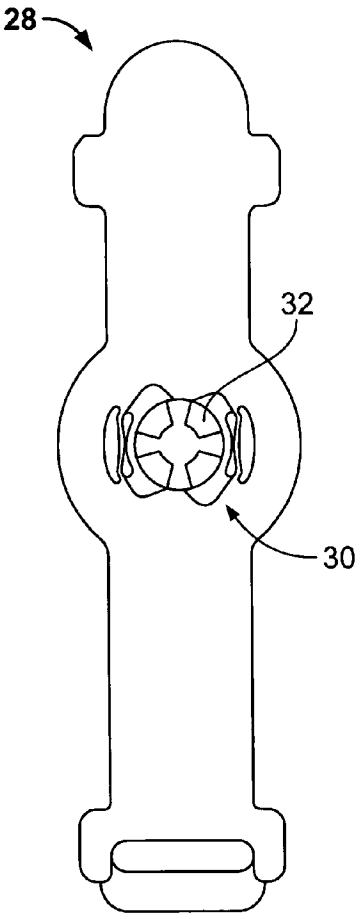

As shown best in FIG. 4, the rotatable knob 18 preferably includes a shank portion 24 and an end cap portion 26. The shank portion 24 is preferably rectangular in cross section and narrow, the long portions thereof being in parallel alignment with the transverse handle 22. The end cap portion 26 is preferably round in shape. Preferably, the height adjustment mechanism of the present invention includes an adjustment slider 28. The adjustment slider 28 preferably includes an engagement portion 30 having downwardly and inwardly extending tabs 32 that is shaped to receive a portion of the rotatable knob 18. Preferably, the tabs 32 are shaped and sized so that when the end cap portion 26 of the rotatable knob 18 is pushed therethrough during assembly, the tabs 32 capture the rotatable knob 18 in a secure, rotatable manner. Preferably the adjustment slider 28 is shaped to be held within a channel 34 created in the juvenile product to provide for easier sliding of the slider 28, and attached rotatable knob 18. Preferably the slider 28 includes a smooth upper portion 38 to facilitate sliding thereof and an attachment portion 40 for attaching the slider to a tether 42 or other portion of a juvenile product needing adjustment.

In operation, a caregiver may rotate the adjustable knob 18 transverse handle 22 so that the handle is parallel to the narrow channels 21 thus allowing the rectangular shank 24 of the rotatable knob 18 to slide within channel 16. Then when the desired adjustment position is reached, i.e. the desired lobe 20 of the channel 16, the caregiver rotates the transverse handle 22 to a position transverse to the channel 16, thereby securely locking the slider 28, and anything attached thereto by attachment portion 40, securely in place.

Following from the above description and invention summaries it should be apparent to those of ordinary skill in the art that, while the systems and processes herein described constitute exemplary embodiments of the present invention, it is understood that the invention is not limited to these precise systems and processes and that changes may be made therein without departing from the scope of the invention as defined by the following claims. Additionally, it is to be understood that the invention is defined by the claims and it is not intended that any limitations or elements describing the exemplary embodiments set forth herein are to be incorporated into the meanings of the claims unless such limitations or elements are explicitly listed in the claims. Likewise, it is to be understood that it is not necessary to meet any or all of the identified advantages or objects of the invention disclosed herein in order to fall within the scope of any claim, as the invention is defined by the claims and because inherent and/or unforeseen advantages of the present invention may exist even though they may not have been explicitly discussed herein.

What is claimed is:

1. A juvenile product height adjustment mechanism comprising:

a rotatable knob having a shank portion having a narrow dimension and a wider dimension and a handle portion;

a channel shaped to receive the shank portion of the rotatable knob slidingly therethrough, the channel comprising at least two adjustment lobes connected to each other by at least one narrow channel wherein the shank portion is shaped such that it may freely slide through the narrow channel when the narrow dimension of the shank is aligned with the narrow channel and is prevented from sliding through the narrow channel when the wider dimension of the shank is not aligned with the narrow channel;

wherein the handle includes a gripping portion thereon, the gripping portion being aligned with the shank portion of the rotatable adjustment knob;

wherein the rotatable knob further comprises an end cap positioned on an opposite end of the rotatable knob than the handle;

an adjustment slider having an opening therein to receive a portion of the rotatable knob; and wherein said opening includes inwardly extending tabs therearound shaped and sized so that when said end cap is pushed therethrough, the tabs capture a the lower portion of the rotatable knob in a secure, rotatable manner.

2. The juvenile product height adjustment mechanism of claim 1 wherein said slider includes an attachment portion thereon.

3. The juvenile product height adjustment mechanism of claim 1 wherein said slider includes a smooth upper portion.

4. The juvenile product height adjustment mechanism of claim 1 wherein said channel is comprised of at least three adjustment lobes and two narrow channels.

5. The juvenile product height adjustment mechanism of claim 1 wherein said adjustment lobes are circular in shape and the narrow channels are rectangular in shape.

6. A juvenile product height adjustment mechanism comprising:

a rotatable knob having a shank portion having a narrow dimension and a wider dimension and a handle portion;

a channel shaped to receive the shank portion of the rotatable knob slidingly therethrough, the channel comprising at least two adjustment lobes connected to each other by at least one narrow channel wherein the shank portion is shaped to slide through the narrow channel when the narrow dimension of the shank is aligned with the narrow channel and is prevented from sliding through the narrow channel when the wider dimension of the shank is not aligned with the narrow channel and wherein the knob further comprises a handle on one end thereof and an end cap on the other end thereof;

wherein the handle includes a gripping portion that is aligned with the shank portion of the rotatable knob;

an adjustment slider having an opening therein to receive a portion of said rotatable knob; and wherein said opening includes inwardly extending tabs therearound shaped and sized so that when said end cap is pushed therethrough, the tabs capture a lower portion of the rotatable knob in a secure, rotatable manner.

7. The juvenile product height adjustment mechanism of claim 6 wherein said slider includes an attachment portion thereon.

8. The juvenile product height adjustment mechanism of claim 6 wherein said slider includes a smooth upper portion.

9. The juvenile product height adjustment mechanism of claim 6 wherein said channel is comprised of at least three adjustment lobes and two narrow channels.

10. The juvenile product height adjustment mechanism of claim 6 wherein said adjustment lobes are circular in shape and the narrow channels are rectangular in shape.

11. A juvenile product height adjustment mechanism comprising:

a rotatable knob having a shank portion having a narrow dimension and a wider dimension and a handle portion;

a first channel formed in a juvenile product, said channel shaped to receive the shank portion of the rotatable knob slidingly therethrough, the channel comprising at least two adjustment lobes connected to each other by at least one narrow channel wherein the shank portion is shaped to slide through the narrow channel when the narrow dimension of the shank is aligned with the narrow channel and is prevented from sliding through the narrow channel when the wider dimension of the shank is not aligned with the narrow channel and further comprising an end cap one end thereof and a handle on the other end thereof; and an adjustment slider having an opening therein to receive a portion of said rotatable knob, said opening having inwardly extending tabs therearound shaped and sized so that when said end cap is pushed therethrough, the tabs capture a lower portion of the rotatable knob in a secure, rotatable manner and including a smooth upper portion, the adjustment slider being shaped to slide within a second channel in the juvenile product.

12. The juvenile product height adjustment mechanism of claim 11 wherein said first channel is comprised of at least three adjustment lobes and two narrow channels.

13. The juvenile product height adjustment mechanism of claim 11 wherein said adjustment lobes are circular in shape and the narrow channels are rectangular in shape.

* * * * *